US009677022B2

(12) United States Patent
Beyer et al.

(10) Patent No.: US 9,677,022 B2
(45) Date of Patent: Jun. 13, 2017

(54) LUBRICANT BASE STOCK

(71) Applicant: CRODA, INC., Edison, NJ (US)

(72) Inventors: Jillian Carli Beyer, Thornton, PA (US); Alexei Nikolaevich Kurchan, Wallingford, PA (US)

(73) Assignee: CRODA, INC., Edison, NJ (US)

( * ) Notice: Subject to any disclaimer, the term of this patent is extended or adjusted under 35 U.S.C. 154(b) by 0 days.

(21) Appl. No.: 14/463,118

(22) Filed: Aug. 19, 2014

(65) Prior Publication Data

US 2016/0053194 A1 Feb. 25, 2016

(51) Int. Cl.

| | |
|---|---|
| ***C07C 69/34*** | (2006.01) |
| ***C07C 69/52*** | (2006.01) |
| ***C10M 173/02*** | (2006.01) |
| ***C10M 105/38*** | (2006.01) |

(52) U.S. Cl.

CPC .. *C10M 105/38* (2013.01); *C10M 2207/2835* (2013.01)

(58) Field of Classification Search

USPC ..... 508/459, 492; 560/199

See application file for complete search history.

(56) References Cited

U.S. PATENT DOCUMENTS

| | | | | |
|---|---|---|---|---|
| 4,658,036 | A | 4/1987 | Schilling | |
| 5,665,686 | A | 9/1997 | Schlosberg et al. | |
| 5,744,434 | A | 4/1998 | Schlosberg et al. | |
| 2008/0026967 | A1* | 1/2008 | Suda et al. | 508/459 |
| 2008/0125338 | A1* | 5/2008 | Corbett et al. | 508/430 |
| 2012/0184474 | A1* | 7/2012 | Kawata et al. | 508/497 |

* cited by examiner

*Primary Examiner* — Vishal Vasisth

(74) *Attorney, Agent, or Firm* — RatnerPrestia

(57) ABSTRACT

The present invention relates to a lubricant base stock, a lubricant composition, a method of lubricating an object and the use of a lubricant base stock. The lubricant base stock comprises a first ester which is the reaction product of: a first polyol comprising at least 3 hydroxyl groups; a first mono-carboxylic acid comprising from 4 to 18 carbon atoms; and a poly-carboxylic acid comprising at least 2 carboxyl groups and comprising from 20 to 60 carbon atoms. The lubricant base stock also comprises a second ester which is the reaction product of: a second polyol comprising at least 3 hydroxyl groups; and a second mono-carboxylic acid comprising from 4 to 18 carbon atoms.

18 Claims, No Drawings

LUBRICANT BASE STOCK

The present invention relates to a lubricant base stock, a lubricant composition, a method of lubricating an object and the use of a lubricant base stock. In particular, the present invention relates to a lubricant base stock which is suitable for lubrication applications where incidental food contact may occur, such as conveyor chains.

Many commercial, domestic, and industrial applications require the use of lubricants, and especially lubricants that can maintain their structure over a wide range of temperature such that they can continue to provide good lubrication properties at elevated temperatures and throughout numerous repeated cycles of elevated temperatures. The applications concerned may involve moving metal parts, the surfaces of which must be lubricated for effective operation.

Such applications include, but are not limited to, fiberglass production, fibreboard production, wood laminating, wood pressing, paint curing, textile production, plastic film stretching, ceramics, food processing and food baking. The lubricants used in these types of applications also need to be able to provide sufficient lubrication to prevent wear, reduce friction, reduce energy consumption, and more importantly, prevent failure of mechanical systems.

Lubricants that are to be used at elevated temperatures must be resistant to thermal and/or oxidative breakdown and polymerization.

Thermal and/or oxidative breakdown leads to the scission of lubricant molecules, which in turn, leads to the formation of lower molecular weight compounds. Lower molecular weight compounds are more volatile than the original lubricant and can be volatilised depending upon the operational conditions of a mechanical system. The residue remaining after the lower molecular weight compounds have volatilised has an increased lubricant viscosity. An increase in lubricant viscosity reduces the mobility of the lubricant, accelerates oxidation, and leads to the formation of deposits. Lubricant breakdown may also result in the loss of lubricant fluid from the system and/or the production of excessive vapours and/or smoke, or ineffective lubrication. This, in turn, can lead to mechanical breakdown, higher energy consumption, reduced cleanliness, poorer product quality, and higher occupational exposure to volatile organic compounds.

Lubricant polymerization can lead to formation of deposits of semi-solid gums and hard varnishes that can build up on metal surfaces. This, in turn, can lead to ineffective lubrication, higher energy consumption, and the need to remove deposits from metal surfaces.

In food processing and cooking/baking applications, including those subject to high temperatures, lubricants are required to keep moving parts, for example conveyor belts, operating smoothly. To provide adequate lubrication throughout the processes, a liquid film of lubricant must remain between metal parts in rubbing, sliding or rolling contact. Therefore, a lubricant must be used which does not evaporate or solidify at the peak processing temperature. The high temperature stable lubricants used in these environments must be safe enough, and within specified levels of toxicity, in case any incidental contact occurs with the food products. Most industrialized countries, including in Europe and the United States, regulate materials for use in these applications to ensure the safety of food products.

NSF International (www.nsf.org) maintains uniform standards for substances such as incidental food additives and lubricants, and its ratings are relied upon throughout the world. If specific criteria are met for a given substance, NSF International grants the substance a rating of H1, for lubricants, or HX-1, for ingredients for use in H1 lubricants, indicating that the substance is suitable for incidental food contact.

Many lubricants based on mineral oils, synthetic hydrocarbon oils or vegetable oils have an NSF International H1 or HX-1 rating. However, these types of lubricant base fluids or base oils (also known as base stocks) have relatively poor performance at high temperatures, either because of inadequate viscosity, excessive evaporation or formation of solid, non-lubricious deposits.

Therefore, there exists a need to provide a lubricant base stock which has good stability at high temperatures so that it can be used to lubricate food processing machinery that is routinely exposed to high temperatures, and which is also safe for incidental food contact.

The present invention seeks to provide a high temperature stable lubricant base stock that can be used in applications where incidental food contact may occur.

Thus viewed from a first aspect, the present invention provides a lubricant base stock for an incidental food contact lubricant composition, the base stock comprising:

a. a first ester which is the reaction product of:
   i. a first polyol comprising at least 3 hydroxyl groups;
   ii. a first mono-carboxylic acid comprising from 4 to 18 carbon atoms; and
   iii. a poly-carboxylic acid comprising at least 2 carboxyl groups and comprising from 20 to 60 carbon atoms; and
b. a second ester which is the reaction product of:
   i. a second polyol comprising at least 3 hydroxyl groups; and
   ii. a second mono-carboxylic acid comprising from 4 to 18 carbon atoms.

Viewed from a second aspect, the present invention provides a lubricant composition for use in an incidental food contact environment comprising a lubricant base stock according to the first aspect.

Viewed from a third aspect, the present invention provides a method of lubricating an object comprising applying a lubricant base stock according to the first aspect or a lubricant composition according to the second aspect to the object.

Viewed from a fourth aspect, the present invention provides the use of a lubricant base stock according to the first aspect in the lubrication of an object in proximity to food.

All of the features described herein may be combined with any of the above aspects, in any combination.

The present invention is based in part on the recognition that at elevated temperatures of 200° C. or higher, a dynamic equilibrium may exist between the first ester and the second ester in the lubricant base stock of the first aspect. Without being bound by theory, it is believed that at elevated temperatures there may be an ongoing trans-esterification process between the first ester and the second ester. The presence of the large poly-carboxylic acid in the first ester (which may have more than double the number of carbon atoms as the mono-carboxylic acid) may slow down the rate of the ongoing trans-esterification process. The size of the poly-carboxylic acid in the first ester may result in a stearic hinderance effect which may lead to a slower growth in the molecular weight of complex or poly-esters formed during the trans-esterification. It may also reduce the amount of mono-carboxylic acids being released during trans-esterification and therefore reduce the volatility of the base stock since the mono-carboxylic acids have a lower molecular weight. Due to the reduction in the formation of higher molecular weight polyesters and the reduction in the loss of lower molecular weight mono-carboxylic acids, the lubricant base stock may remain liquid for a longer period of time when exposed to elevated temperatures.

As used herein, the terms 'for example,' 'for instance,' 'such as,' or 'including' are meant to introduce examples that further clarify more general subject matter. Unless otherwise specified, these examples are provided only as an aid for understanding the applications illustrated in the present disclosure, and are not meant to be limiting in any fashion.

It will be understood that, when describing the number of carbon atoms in a substituent group (e.g. 'C1 to C6'), the number refers to the total number of carbon atoms present in the substituent group, including any present in any branched groups. Additionally, when describing the number of carbon atoms in, for example fatty acids, this refers to the total number of carbon atoms including the one at the carboxylic acid, and any present in any branch groups.

It will be understood that any upper or lower quantity or range limit used herein may be independently combined.

Many of the chemicals which may be used to produce the first ester and second ester used in the present invention are obtained from natural sources. Such chemicals typically include a mixture of chemical species due to their natural origin. Due to the presence of such mixtures, various parameters defined herein can be an average value and may be non-integral.

The term 'polyol' is well known in the art, and refers to an alcohol comprising more than one hydroxyl group. The term 'active hydrogen' refers to the hydrogen atoms present as part of the hydroxyl groups of the polyol.

Mixtures may be employed, and therefore the degree of esterification can be an average value and may be non-integral.

Preferably, the lubricant base stock is a high temperature stable composition. Preferably, the first ester and/or second ester is a high temperature stable ester.

Preferably, the lubricant composition is a chain oil, more preferably a high temperature chain oil.

Preferably, the lubricant base stock has a residual OH concentration of less than 5% by weight of the total weight of the OH groups present in the starting materials.

By the use of the term "high temperature stable" herein, it is meant a composition that can be exposed to temperatures of at least 200° C. for at least one hour without undergoing substantial degradation, such as oxidative breakdown and/or thermal breakdown.

By the use of the term "food-safe" herein, it is meant a composition or lubricant that meets the criteria to achieve an "H1" or "HX-1" classification from NSF International or an equivalent rating or classification from a counterpart standards setting body.

By the use of the term "residual OH group concentration" herein, it is meant the concentration of free, unreacted OH, or hydroxy, groups present in the first and/or second ester after initial esterification. The concentration is given as a percentage of the total concentration of free OH, or hydroxy, groups present in the individual polyol, monocarboxylic acid and dicarboxylic acid starting materials.

Preferably, the residual OH group concentration of the first ester, second ester and/or lubricant base stock is less than 4.9%, preferably less than 4.5% and most preferably less than 4% by weight based on the total weight of the OH groups in the starting materials. Preferably, the residual OH group concentration can be as low as 0.05%, preferably 0.1% by weight based on the total OH concentration in the starting materials. The residual OH group concentration is determined by calculating the hydroxyl value according to ASTM D1957 by the acetylation of free hydroxyl groups in a pyridine solvent, and the subsequent titration with potassium hydroxide. Preferably, the first ester, second ester and/or base stock has a hydroxyl value of at most 18 mg KOH/g. The first ester, second ester and/or base stock may have a hydroxyl value of at most 10 mg KOH/g.

Polyol

The features of the first and/or second polyol described herein may apply to the first polyol independently, to the second polyol independently or to both polyols. The first and/or second polyol may be represented generally by the formula:

$$R^1(OH)_n$$

wherein $R^1$ is any aliphatic or cyclo-aliphatic hydrocarbyl group, preferably an alkyl, and n is at least 3. The $R^1$ group may represent a single species or a mixture.

The group $R^1$ may comprise from about 2 to about 20 carbon atoms, and the hydrocarbyl group may also comprise substituents such as chlorine, nitrogen and/or oxygen atoms. The first and/or second polyol generally may contain one or more oxyalkylene groups and, thus, may be a compound such as a polyetherpolyol.

Preferably, the first and/or second polyol comprises at least 2 carbon atoms, preferably at least 3 carbon atoms, more preferably at least 4 carbon atoms and most preferably at least 5 carbon atoms. Preferably, the first and/or second polyol comprises up to 30 carbon atoms, preferably up to 26 carbon atoms, more preferably up to 24 carbon atoms and most preferably up to 20 carbon atoms.

Preferably, the first and/or second polyol comprises a quaternary carbon atom. Preferably, at least one of the first polyol and the second polyol comprises a quaternary carbon atom.

The first and/or second polyol comprises at least 3 hydroxyl groups. The first and/or second polyol may comprise at most 6 hydroxyl groups, preferably at most 5 hydroxyl groups, more preferably at most 4 hydroxyl groups.

Preferably, the first and/or second polyol is a branched polyol, more preferably a dibranched or polybranched polyol. Preferably, it is a neopentyl-type polyol. The first and/or second polyol is preferably selected from the group of trimethylol ethane, trimethylol propane, trimethylol butane, mono-pentaerythritol, technical grade pentaerythritol, di-pentaerythritol, tri-pentaerythritol, sorbitol and mixtures thereof. Particularly preferred polyols are technical grade pentaerythritol, monopentaerythritol, di-pentaerythritol, trimethylol propane and mixtures thereof. Technical grade pentaerythritol comprises approximately 88 wt % mono-pentaerythritol, 10 wt % di-pentaerythritol and 1-2 wt % tri-pentaerythritol. Preferably, the first polyol and the second polyol comprise at least one of: trimethylol propane, pentaerythritol and di-pentaerythritol. In a preferred embodiment, the first and/or second polyol is or consists essentially of trimethylol propane.

Mono-Carboxylic Acid

The features of the first and/or second monocarboxylic acid described herein may apply to the first monocarboxylic acid independently, to the second monocarboxylic acid independently or to both monocarboxylic acids. The first and/or second monocarboxylic acid may be represented generally by the formula:

$$R^2COOH$$

wherein $R^2$ is a branched or linear, aliphatic, saturated or unsaturated hydrocarbyl group. The $R^2$ group comprises from 3 to 17 carbon atoms, and may also comprise substituents such as chlorine, nitrogen and/or oxygen atoms.

Preferably, the monocarboxylic acid comprises at least 5 carbon atoms, more preferably at least 6 carbon atoms. Preferably, the monocarboxylic acid comprises at most 16, more preferably at most 14 and most preferably at most 12 carbon atoms. The $R^2$ group may represent a single species or a mixture, preferably a mixture.

The first and/or second monocarboxylic acid is preferably selected from the group comprising butyric acid, pentanoic acid, hexanoic acid (caproic acid), heptanoic acid, octanoic acid (caprylic acid), nonanoic acid, decanoic acid (capric acid), dodecanoic acid (lauric acid), 2,2-dimethyl propionic acid (neopentanoic acid), neoheptanoic acid, neooctanoic acid, neononanoic acid, iso-hexanoic acid, neodecanoic acid, 2-ethyl hexanoic acid (2EH), 3,5,5-trimethyl hexanoic acid (TMH), isoheptanoic acid, isooctanoic acid, isononanoic acid and isodecanoic acid and mixtures thereof.

Preferably, the monocarboxylic acid is a linear acid and preferably it is not branched. The monocarboxylic acid is preferably selected from butyric acid, pentanoic acid, hexanoic acid (caproic acid), heptanoic acid, octanoic acid (caprylic acid), nonanoic acid, decanoic acid (capric acid) or dodecanoic acid (lauric acid) and mixtures thereof. More preferably the monocarboxylic acid is selected from hexanoic acid (caproic acid), heptanoic acid, octanoic acid (caprylic acid), nonanoic acid and decanoic acid (capric acid) and mixtures thereof.

Two or more monocarboxylic acids may be present as a mixture in the first and/or second mono-carboxylic acid, more preferably two or three monocarboxylic acids are present as a mixture. Preferred mixtures are mixtures of linear monocarboxylic acids.

Monocarboxylic acids suitable for use herein can be obtained from natural sources such as, for example plant or animal esters. For example, the acids may be obtained from palm oil, rape seed oil, palm kernel oil, coconut oil, babassu oil, soybean oil, castor oil, sunflower oil, olive oil, linseed oil, cottonseed oil, safflower oil, tallow, whale or fish oils, grease, lard and mixtures thereof. Resin acids, such as those present in tall oil, may also be used.

Poly-Carboxylic Acid

The poly-carboxylic acid may be represented generally by the formula:

$$R^3(COOH)_m$$

wherein $R^3$ is a branched or linear, aliphatic, cyclo-aliphatic or aromatic, saturated or unsaturated hydrocarbyl group, and m is at least two. The hydrocarbyl group may also comprise substituents such as chlorine, nitrogen and/or oxygen atoms. The $R^3$ group may represent a single species or a mixture, preferably a mixture. The number of carboxyl groups in the poly-carboxylic acid (value of m) is at least 2 and may be at most 6, preferably at most 5, more preferably at most 4.

The poly-carboxylic acid comprises from 20 to 60 carbon atoms. The poly-carboxylic acid may comprise at least 24 carbon atoms, preferably at least 28, more preferably at least 32. The poly-carboxylic acid may comprise at most 58 carbon atoms, preferably at most 54, more preferably at most 50.

The poly-carboxylic acid may be stearically hindered due to its size. The polycarboxylic acid may be more stearically hindered than the first and/or second monocarboxylic acid. The polycarboxylic acid may be more stearically hindered than the first and/or second polyol.

The poly-carboxylic acid may be a di-carboxylic acid. Preferably the polycarboxylic acid comprises dimer diacid and/or a dicarboxylic acid produced by a Diels Alder type reaction. The poly-carboxylic acid may be, consist essentially of or comprise dimer diacid.

The term dimer diacid (also referred to as dimer fatty acid) is well known in the art and refers to the dimerisation product of mono- or polyunsaturated fatty acids and/or esters thereof. The dimer diacids may be dimers of C12 to C24 alkyl chains, preferably C14 to C22, more preferably C16 to C20 and especially C18 alkyl chains. Suitable dimer diacids include the dimerisation products of oleic acid, linoleic acid, linolenic acid, palmitoleic acid, and elaidic acid with oleic acid being particularly preferred. The dimerisation products of the unsaturated fatty acid mixtures obtained in the hydrolysis of natural fats and oils, e.g. sunflower oil, soybean oil, olive oil, rapeseed oil, cottonseed oil and tall oil, may also be used. These dimer fatty diacids have iodine values typically of at least 100, measured according to a test method equivalent to ASTM D1959-85. Hydrogenated, for example by using a nickel, platinum or palladium catalyst, dimer diacids may also be employed. These hydrogenated dimer fatty acids have iodine values less than 25, preferably less than 20, more preferably less than 15, especially less than 10. Hydrogenated dimer diacids are preferred for use in the present invention.

In addition to the dimer diacids, dimerisation usually results in varying amounts of oligomeric fatty acids (so-called "trimer") and residues of monomeric fatty acids (so-called "monomer"), or esters thereof, being present. The amount of monomer and trimer can, for example, be reduced by distillation. Particularly preferred dimer fatty diacids used in the present invention, have a dimer content of greater than 50%, more preferably greater than 70%, particularly greater than 85%, and especially greater than 90% by weight. The trimer content is preferably less than 50%, more preferably in the range from 1 to 20%, particularly 2 to 10%, and especially 3 to 6% by weight. The monomer content is preferably less than 5%, more preferably in the range from 0.1 to 3%, particularly 0.3 to 2%, and especially 0.5 to 1% by weight.

A dicarboxylic acid produced by a Diels-Alder type reaction (e.g. Diels-Alder condensation) may be a product of a reaction between a poly-unsaturated fatty acid and an acrylic, fumaric or maleic ester as described in U.S. Pat. No. 4,658,036, which is incorporated herein by reference. Commercially available examples of a dicarboxylic acid produced by a Diels-Alder type reaction are Westvaco DIACID 1525 and Westvaco DIACID 1550, both being available from the Westvaco Corporation Ester Production The first and/or second esters may be produced under standard esterification conditions. In particular, the ester can be produced in a one step reaction by mixing all the starting materials together at a temperature of between 150° C. and 250° C. The reaction may occur in the presence of a catalyst, for example titanates including butyl isopropyl titanate, hypophosphorus acid or/and mono- or dibasic sodium or potassium salts of hyposphosphorus acids or other basic or acidic catalysts, or the like. The esterification reaction is preferably undertaken until the concentration of residual OH groups in the ester product is less than 5% by weight based on the total concentration of OH groups in the staring materials.

First Ester

The first ester may comprise at least 3 ester bonds, preferably at least 4, more preferably at least 5. The first ester may comprise at most 10 ester bonds, preferably at most 8.

In the first ester, the molar ratio of mono-carboxylic acid to polyol is preferably at most 10:1, preferably at most 8:1, more preferably at most 6:1 and most preferably at most 4:1. The molar ratio of monocarboxylic acid to polyol in the first ester is preferably at least 0.5:1, more preferably at least 1:1, more preferably at least 1.5:1.

In the first ester, the molar ratio of polyol to poly-carboxylic acid is preferably at most 10:1, preferably at most 8:1, more preferably at most 6:1 and most preferably at most 4:1. The molar ratio of polyol to poly-carboxylic acid in the first ester is preferably at least 0.5:1, more preferably at least 1:1, more preferably at least 1.5:1.

The first ester preferably has an acid value measured according to AOCS 1989 methods Ca 5a-40 and Cd 3d-63, Te 1a-64, or ASTM D664, of less than 2 mg KOH/g, preferably less than 1.5 mg KOH/g, more preferably less than 1 mg KOH/g and most preferably less than 0.6 mg KOH/g. Preferably, the ester has as low an acid value as possible. The lower limit of the acid value range may be in the region of 0.05 mg KOH/g.

An Anton Paar Stabinger SVM 3000 viscometer may be used to measure the kinematic viscosity of the first ester. The first ester preferably has a kinematic viscosity measured at 40° C. of at least 100 cSt (equivalent to 100 $mm^2/s$), preferably at least 125 cSt, more preferably at least 175 cSt and most preferably at least 200 cSt. Preferably, the first ester has a kinematic viscosity measured at 40° C. of at most 5000 cSt, preferably at most 2000 cSt, more preferably at most 1000 cSt and most preferably at most 500 cSt.

The first ester preferably has a kinematic viscosity measured at 100° C. of at least 10 cSt, preferably at least 13 cSt, more preferably at least 17 cSt and most preferably at least 20 cSt. Preferably, the first ester has a kinematic viscosity measured at 100° C. of at most 1000 cSt, preferably at most 500 cSt, more preferably at most 200 cSt and most preferably at most 100 cSt.

Second Ester

The second ester may comprise at least 1 ester bond, preferably at least 1.5, more preferably at least 2. The second ester may comprise at most 6 ester bonds, preferably at most 4.

In the second ester, the molar ratio of mono-carboxylic acid to polyol is preferably at most 10:1, preferably at most 8:1, more preferably at most 6:1 and most preferably at most 4:1. The molar ratio of mono-carboxylic acid to polyol in the second ester is preferably at least 1:1, more preferably at least 1.5:1, more preferably at least 2:1.

The second ester preferably has an acid value measured according to AOCS 1989 methods Ca 5a-40 and Cd 3d-63, Te 1a-64, or ASTM D664, of less than 2 mg KOH/g, preferably less than 1.5 mg KOH/g, more preferably less than 1 mg KOH/g and most preferably less than 0.6 mg KOH/g. Preferably, the ester has as low an acid value as possible. The lower limit of the acid value range may be in the region of 0.05 mg KOH/g.

An Anton Paar Stabinger SVM 3000 viscometer may be used to measure the kinematic viscosity of the second ester. The second ester preferably has a kinematic viscosity measured at 40° C. of at least 2 cSt, preferably at least 5 cSt, more preferably at least 10 cSt. Preferably, the second ester has a kinematic viscosity measured at 40° C. of at most 1000 cSt, preferably at most 500 cSt, more preferably at most 200 cSt and most preferably at most 100 cSt.

The second ester preferably has a kinematic viscosity measured at 100° C. of at least 1 cSt, preferably at least 2 cSt. Preferably, the second ester has a kinematic viscosity measured at 100° C. of at most 100 cSt, preferably at most 50 cSt, more preferably at most 20 cSt and most preferably at most 10 cSt.

Base Stock

The first ester may have a kinematic viscosity value at 40° C. which is at least 6 times greater than that of the second ester, preferably at least 8 times greater, more preferably at least 10 times greater.

The weight ratio of the first ester to the second ester in the lubricant base stock may be at least 0.1:1, preferably at least 0.25:1, more preferably at least 0.5:1. The weight ratio of the first ester to the second ester in the lubricant base stock may be at most 50:1, preferably at most 20:1, more preferably at most 15:1. Preferably the weight ratio of the first ester to the second ester in the lubricant base stock is from 0.25:1 to 20:1.

The lubricant base stock preferably has an acid value measured according to AOCS 1989 methods Ca 5a-40 and Cd 3d-63, Te 1a-64, or ASTM D664, of less than 2 mg KOH/g, preferably less than 1.5 mg KOH/g, more preferably less than 1 mg KOH/g and most preferably less than 0.6 mg KOH/g. Preferably, the lubricant base stock has as low an acid value as possible. The lower limit of the acid value range may be in the region of 0.05 mg KOH/g.

An Anton Paar Stabinger SVM 3000 viscometer may be used to measure the kinematic viscosity of the lubricant base stock. The base stock preferably has a kinematic viscosity measured at 40° C. of at least 10 cSt, preferably at least 20 cSt, more preferably at least 30 cSt. Preferably, the lubricant base stock has a kinematic viscosity measured at 40° C. of at most 1000 cSt, preferably at most 600 cSt, more preferably at most 400 cSt. Preferably the kinematic viscosity of the base stock at 40° C. is from 10 cSt to 600 cSt.

The lubricant base stock preferably has a kinematic viscosity measured at 100° C. of at least 1 cSt, preferably at least 2 cSt. Preferably, the lubricant base stock has a kinematic viscosity measured at 100° C. of at most 100 cSt, preferably at most 50 cSt.

Preferably the base stock satisfies the NSF International criteria for incidental food contact. For example, the base stock may satisfies the NSF International criteria for HX or HX-1 certification. Preferably the base stock is a food-safe base stock.

Lubricant Composition

In its second aspect, the present invention provides a lubricant composition for use in a food contact environment comprising a lubricant base stock according to the first aspect.

The lubricant composition may contain only the lubricant base stock comprising the first ester and second ester described above. In this embodiment, the lubricant composition consists essentially of the first ester and second ester. In one embodiment of the invention, therefore, there is provided a lubricant composition consisting essentially of a lubricant base stock according to the first aspect of the invention.

The lubricant composition may further comprise at least one antioxidant as an additive.

The lubricant composition may further comprise an additive package.

Preferably, the lubricant composition comprises at least 1 wt % of the base stock of the first aspect of the invention, preferably at least 2 wt %, more preferably at least 5 wt % based on the total weight of the composition. Preferably, the lubricant composition comprises up to 99.9 wt % of the base stock, preferably up to 99 wt %, preferably up to 90 wt %, preferably up to 80 wt %, more preferably up to 50 wt %, more particularly up to 30 wt %, most preferably up to 20 wt % and desirably up to 10 wt % based on the total weight of the composition.

The lubricant composition may comprise at least 0.1 wt % of the at least one additive or additive package, preferably at least 0.5 wt %, more preferably at least 1 wt %, and desirably at least 2 wt % based on the total weight of the composition. The lubricant composition may comprise up to 40 wt % of the at least one additive or additive package, preferably up to 30 wt %, more preferably up to 20 wt % and desirably up to 10 wt % based on the total weight of the composition.

The lubricant composition may comprises at least 1 wt % of a further base oil, preferably at least 20 wt %, more preferably at least 40 wt %, and most preferably at least 60 wt % based on the total weight of the composition. Preferably, the lubricant composition comprises up to 90 wt % of a further base oil, preferably up to 70 wt %, more particularly up to 50 wt %, desirably up to 30 wt % based on the total weight of the composition.

The further base oil may be selected from the group of mineral oils, highly refined mineral oils, alkylated mineral oils, poly alpha olefins, polyalkylene glycols, phosphate esters, silicone oils, diesters, polyol esters and mixtures thereof.

The additive package may comprise one or more additives suitable for the intended use of the lubricant composition. Suitable optional additives may include aesthetic/organoleptic agents, one or more antioxidants (or an antioxidant system), rheology modifiers, antiwear additives, metal passivizing agents, dry lubricants (such as graphite or PTFE), other liquid lubricants, lubricating property modifiers (additives for improving one or more lubricating properties), preservatives and combinations of two or more of these additives.

Any or all of these additives may be present in the composition as long as the additives, either individually or combined, do not substantially affect the food safety properties of the composition, for example they do not render a composition deemed to be food safe under the NSF International rating system to be a non-food safe composition. In some embodiments, the additives may be selected and combined to optimize the high temperature performance of the finished lubricant or composition.

Particularly preferred additives include antioxidants or antioxidant systems, wherein an antioxidant system comprises two or more antioxidants in combination. Suitable examples of antioxidants and antioxidant systems include, but are not limited to, arylamines, phenol-containing compounds, hindered phenols, alkylated diphenyl amines and mixtures thereof. One or more antioxidants may be selected from the group of 2,6-di-tert-butyl-p-cresol, isobutylenated methylstyrenated phenol, styrenated phenol, octadecanoxy carbonylether phenol, dioctyl diphenyl amine and mixtures thereof. Suitable commercially available antioxidants include IRGANOX® L06, L57, L64, L109, L115, and L150 ex BASF and VANLUBE 81, 961, and 7723 ex Vanderbilt Corporation.

Such antioxidants or antioxidant systems are preferably present in the lubricant composition at a total concentration of between 0.1% and 5% by weight based on the total weight of the lubricant composition, more preferably between 0.5% and 4%, and most preferably between 1% and 3%. Each individual antioxidant may be present at between 0.1% and 1% by weight based on the total weight of the lubricant composition.

The individual additives, or additive packages, may be incorporated into the base stock in any suitable way, for example by dispersing or dissolving the additives, or additives packages, into the base stock at room or elevated temperature.

Preferably, the lubricant composition is anhydrous. By the term anhydrous, it is meant that the composition has a water content of less than 5%, preferably less than 2%, more preferably less than 1% and most preferably less than 0.2%.

The lubricant composition preferably has an extrapolated onset temperature, determined according to ASTM E2550, of at least 180° C., preferably at least 200° C., more preferably at least 230° C. and most preferably at least 250° C.

The lubricant composition may be a chain oil.

In its third aspect, the present invention provides a method of lubricating an object comprising applying a lubricant base stock according to the first aspect or a lubricant composition according to the second aspect to the object.

The object may be exposed to an elevated temperature of at least 200° C., preferably at least 220° C., more preferably at least 240° C. for a period of time.

The period of time may be at least 5 minutes, preferably at least 15 minutes, more preferably at least 30 minutes, even more preferably at least 1 hour, desirably at least 4 hours.

The object may repeatedly exposed to the elevated temperature over more than 1 heating and cooling cycle, preferably at least 5 cycles, more preferably at least 10 cycles, even more preferably at least 20 cycles, desirably at least 40 cycles.

The object may be a chain in a food-contact environment or food processing equipment. Such equipment can include any used to cook, prepare, process, or package any food or any element that comes in direct contact with food, including, for example, beverages, baked goods, dairy products, pre-prepared frozen or shelf stable foods, canned foods, packed meats, vegetables, fruits, and pastas, processed nuts, sweets or other confections. Such equipment may include, for example, devices and machinery used in processes of cooking, baking, boiling, roasting, braising, sterilizing, drying, broiling, steaming, frying, chopping, mixing, stirring, conveying, pressing, carrying, forming, sorting, cutting, folding, flipping, packaging, or handling the food ingredients under heat. Examples include ovens, conveyor belts, mixers, tanks, vats, grills, heated surfaces, presses, molds, pans, pots, curd presses, fermentation tanks, food handling implements and utensils, sorters, fruit washers, dishwashers, and the like. Additionally, the equipment to which the lubricant is applied may be any that is used to process products placed in close contact with mammalian tissues, even though the products are not necessarily ingested. For example, such equipment may include equipment used in the manufacture of pharmaceuticals, vitamins, contact lenses, dermal patches, soaps, shampoos, oral care products, medical devices, bandages, nappies, medical implements and the like.

The lubricant base stock of the first aspect or the lubricant composition of the second aspect of the invention may be applied to the equipment or chain by any suitable means. In one embodiment, the method of application of the lubricant composition to the equipment may include spraying, dipping, brushing, wiping, sponging, flushing or irrigating. The method of application may be accomplished manually or may be an automated process.

In its fourth aspect, the present invention provides the use of a lubricant base stock according to the first aspect in the lubrication of an object in proximity to food.

Any of the features discussed herein may be taken in any combination with any aspect of the invention.

EXAMPLES

The present invention will now be described further, for illustrative purposes only, in the following examples. All parts and percentages are given by weight unless otherwise stated.

It will be understood that all tests and physical properties listed have been determined at atmospheric pressure and room temperature (i.e. about 20° C.), unless otherwise stated herein, or unless otherwise stated in the referenced test methods and procedures.

Example 1

Preparation of First Ester

A reactor is used which is equipped with a reflux column for separation of condensation water and the distillates, a nitrogen sparge, and a decantor for separating organic in the condensate from water and returning the organic back to the reactor. A mixture of caprylic/capric acid first portion (120 g), dimer diacid (a $C_{36}$ dimer dicarboxylic acid available ex Croda, 191 g), and trimethylol propane (TMP, 114 g), is added to the reactor. With agitation on, start nitrogen purge and heating. Once the reaction temperature reaches 180° C. reflux the reaction mixture. Raise temperature to 220° C. while separating water and returning unreacted acids to the reactor. Hold the reaction temperature at 220° C. for 3 hours. Charge the second portion of mixture of caprylic/capric acid (175 g). Hold the reaction temperature at 220° C. for additional 2-3 hours. Add TBT catalyst and apply partial vacuum 500 torr to 100 torr over 30 minutes. Hold the reaction at 210-220° C. for 2 more hours. Apply vacuum to the reactor to remove the excess acid by increasing the vacuum slowly to 20 torr. Hold the vacuum stripping at 220° C. for 2-3 hours. Break the vacuum with nitrogen. Once the reactor is filled with nitrogen, re-apply vacuum to the reactor to 20 torr or better. Hold the vacuum for 20-30 minutes. Repeat the last step for removing the residual acid, until Acid Number<0.3. Cool the product to 80° C., and discharge the product.

Example 2

Preparation of Second Ester

A reactor is used which is equipped with a reflux column for separation of condensation water and the distillates, a nitrogen sparge, and a decantor for separating organic in the condensate from water and returning the organic back to the reactor. A mixture of caprylic/capric acid (1174 g) is added into the reactor. Withhold a small amount of the acid (15-20 ml) for use to aid the charge of the catalyst. With agitation on, charge TMP (305 g) into the reactor. Start nitrogen sparge after all TMP is charged. Heat the reactor to 140° C. Once the reaction temperature reaches 140° C., condensation water starts to come off. The reaction temperature rises slowly from 140 to 215° C. over 2 to 4 hours. The condensate separates into two phases clearly, and the acid (the top phase) can be easily recovered. Hold the reaction temperature at 215° C. With the aid of a small amount of the acid (15-20 ml), charge TBT catalyst into the reactor. Hold the reaction at 210-220° C. for 3 hours. Cool the reaction to 190° C. Apply vacuum to the reactor slowly to remove the excess acid. The acid starts to come off at about 560 mm Hg. Keep stripping the acid by increasing the vacuum slowly. Hold the vacuum stripping at 190° C. for 2 hours. Break the vacuum with nitrogen. Once the reactor is filled with nitrogen, re-apply vacuum to the reactor to 720 mm Hg or better. Hold the vacuum for 20-30 minutes. Repeat the last step for removing the residual acid.

Example 3

Preparation of Lubricant Base Stocks and Lubricant Compositions

The first ester from Example 1 and the second ester from Example 2 were mixed as shown in Table 1 to prepare various lubricant base stocks for testing in the following examples.

TABLE 1

Preparation of lubricant base stocks

| Lubricant Base Stock | Amount of first ester (wt %) | Amount of second ester (wt %) |
|---|---|---|
| A | 46 | 54 |
| B | 60 | 40 |
| C | 90 | 10 |

Example 4

Thin Film Testing of First and Second Ester Compared with Lubricant Base Stocks A to C To each of the neat first ester, neat second ester and lubricant base stocks A, B and C were added the antioxidants IRGANOX® L06 (at 1.5 wt % treat rate) and VANLUBE 81 (at 1.5 wt % treat rate). The total antioxidant treat rate was 3 wt %. The formulated ester and antioxidant samples were then tested for heat resistance according to the following thin film test procedure.

Thin film test procedure: 2 g of each sample was placed into separate smooth walled pre-weighted aluminum dishes (7 cm diameter). The samples were placed into a forced air oven at 250° C. After 8 hours of heating, the samples were taken out of the oven, allowed to cool down and weighed. This allowed the percentage weight loss of the initial sample to be calculated. To determine the residue deposited as a percentage of the initial sample, the dishes were inverted on a metal tray and placed into 70° C. oven for 1 hour to allow all liquid material to drain. Next, the dishes were weighed and the amount of residue deposited was determined by the difference between the empty dish weight and the measured weight. The amount of residue deposited when compared with the initial sample weight gives the percentage residue.

The results of the thin film test are given in Table 2.

TABLE 2

Thin film test results after 8 hours at 250° C.

| Sample formulated with antioxidant | Weight Loss | Residue | Physical State after 8 hours at 250° C. |
|---|---|---|---|
| First ester | 43% | 57% | Solid |
| Second ester | 87% | 13% | Solid |
| Lubricant base stock A | 75% | 10% | Liquid |

TABLE 2-continued

| Thin film test results after 8 hours at 250° C. | | | |
|---|---|---|---|
| Sample formulated with antioxidant | Weight Loss | Residue | Physical State after 8 hours at 250° C. |
| Lubricant base stock B | 62% | 10% | Liquid |
| Lubricant base stock C | 41% | 10% | Liquid |

The results shown in Table 2 indicate that the lubricant base stocks A, B and C are able to retain their liquid form after 8 hours at high temperature (250° C.) and so provide effective lubricant compositions in applications where high temperatures are employed, for example in food processing applications.

It can be seen from Table 2 that there is a beneficial interaction between the first ester and the second ester in the lubricant base stocks A, B and C which improves their resistance to thermal and/or oxidative breakdown and polymerization. Both the neat first ester and the neat second ester samples have become solid after 8 hours at 250° C. i.e. they have been polymerized, degraded, or evaporated). In contrast the lubricant base stocks A, B and C all remain liquid i.e. they have resisted thermal and/or oxidative breakdown and polymerization. In addition, lubricant base stocks A, B and C each leave a lower residue (10%) after 8 hours when compared with the first ester (57%) or the second ester (13%) separately.

Without being bound by theory, it is believed that at the elevated temperature of 250° C. there may be an ongoing trans-esterification process between the first ester and the second ester. The presence of the large dimer diacid group in the first ester may slow down the rate of the trans-esterification. The combination of the ongoing trans-esterification process with the rate slowing function of the dimer diacid improves the resistance to thermal and/or oxidative breakdown and polymerization of lubricant base stocks. A, B and C.

Each feature disclosed herein may be replaced by alternative features serving the same, equivalent or similar purpose. Therefore, each feature disclosed is one example only of a generic series of equivalent or similar features.

The invention claimed is:

1. A lubricant base stock for a food-safe lubricant composition, comprising:

a. a first ester which is the reaction product of:

i. a first polyol comprising at least 3 hydroxyl groups; and ii. a first mono-carboxylic acid comprising from 4 to 18 carbon atoms; and iii. a poly-carboxylic acid comprising at least 2 carboxyl groups and comprising from 32 to 60 carbon atoms, wherein the poly-carboxylic acid comprises a dimer diacid; and b. a second ester which is the reaction product of:

i. a second polyol comprising at least 3 hydroxyl groups; and ii. a second mono-carboxylic acid comprising from 4 to 18 carbon atoms, wherein the first ester has a kinematic viscosity value at 40° C. which is at least 6 times greater than that of the second ester.

2. A base stock according to claim 1, wherein the weight ratio of the first ester to the second ester is from 0.25:1 to 20:1.

3. A base stock according to claim 1, wherein at least one of the first polyol and the second polyol comprises a quaternary carbon atom.

4. A base stock according to claim 1, wherein at least one of the first polyol and the second polyol comprise at least one of: trimethylol propane, pentaerythritol and di-pentaerythritol.

5. A base stock according to claim 1, wherein the kinematic viscosity of the base stock at 40° C. is from 10 cSt to 600 cSt.

6. A lubricant composition for use in an incidental food-contact environment comprising a lubricant base stock according to claim 1.

7. A lubricant composition according to claim 6, further comprising at least one antioxidant.

8. A lubricant composition according to claim further comprising an additive package.

9. A lubricant composition according to claim 6, wherein the lubricant composition is a chain oil.

10. A method of lubricating an object comprising applying a lubricant base stock according to claim 1 to the object.

11. A method according to claim 10, wherein the object is exposed to a temperature of at least 200° C. for a period of time.

12. A method according to claim 11, wherein the period of time is at least 5 minutes.

13. A method according to claim 11, wherein the object is repeatedly exposed to a temperature of at least 200° C. over more than one heating and cooling cycle.

14. A method according to claim 10, wherein the object is a chain in a food-contact environment or food processing equipment.

15. A method of lubricating an object in proximity to food, comprising applying a lubricant base stock according to claim 1 to the object, wherein the object is in proximity to food.

16. A base stock according to claim 4, wherein the first polyol and the second polyol comprise at least one of: trimethylol propane, pentaerythritol and di-pentaerythritol.

17. A method of lubricating an object comprising applying a lubricant composition according to claim 6 to the object.

18. A base stock according to claim 1, wherein the first ester, the second ester, and/or the base stock has a hydroxyl value of at most 18 mg KOH/g.

* * * * *